US005133084A

United States Patent [19]

Martin

[11] Patent Number: 5,133,084

[45] Date of Patent: Jul. 28, 1992

[54] AUTOMATICALLY INFLATABLE COLLAR SAFETY DEVICE

[76] Inventor: Richard L. Martin, 1020 Shadowwood, Lewisville, Tex. 75067

[21] Appl. No.: 796,783

[22] Filed: Nov. 25, 1991

[51] Int. Cl.[5] ..... B60R 21/22; A42B 3/02

[52] U.S. Cl. ..... 2/2; 2/DIG. 3; 280/730

[58] Field of Search ..... 2/2, DIG. 3; 280/728, 280/730; 441/123

[56] References Cited

U.S. PATENT DOCUMENTS 3,930,667 1/1976 Osuchowski ..... 2/DIG. 3 X
4,984,821 1/1991 Kim et al. ..... 2/2 X

FOREIGN PATENT DOCUMENTS 0043990 1/1982 European Pat. Off. ..... 2/2
2499373 8/1982 France ..... 2/DIG. 3

*Primary Examiner*—Peter Nerbun
*Attorney, Agent, or Firm*—James O. Dixon

[57] ABSTRACT

An automatically inflatable safety collar device comprising a collar made of a "C" shaped control ring resilient rod member, an inflatable rubber tube member surrounding the rod with a first cap attached to one end of said rod and sealing one end of said tube and a second cap with a gas inlet nipple attached to the other end of the rod and sealed to the tube, a generally "C" shaped foamed cushion member of toroidal arc contour hollow through its length split at its inner periphery from inner surface to outer surface and surrounding the tube and a stretchable fabric cover surrounding the cushion, a compressed gas container, a gas release trigger device, a gas transfer pressure line connected between the container and the nipple; and a trigger device operating tether cord attachable to a vehicle.

19 Claims, 2 Drawing Sheets

AUTOMATICALLY INFLATABLE COLLAR SAFETY DEVICE

This invention relates to personal safety equipment and more particularly to an automatically inflatable collar to be worn by vehicle riders to prevent or reduce vehicle crash neck injuries.

BACKGROUND

Many vehicles currently in use do not provide structural enclosure for the operator and passengers. Thus, the operator and passengers of vehicles such as motorcycles, three-wheel and four-wheel all terrain vehicles, jet skis and other vehicles are potentially subject to more severe injury particularly to the head and neck areas as a result of crashes or collisions of the vehicles, especially if the speeds involved tend to throw the operator and passengers off or out of the vehicle.

While it is often required that safety helmets be worn by all persons riding such vehicles it has been found that safety helmets although protecting against head injury in accidents may contribute to more severe neck injuries.

SUMMARY OF INVENTION

The present invention comprises an automatically inflatable cushioning collar especially suitable for wear with a safety helmet and designed to prevent or lessen the severity of neck injury from vehicle crash or collision.

The collar of the present invention comprises an inflatable tubular member having an internal metal or plastic resilient member constraining the tubular member to a generally "C" or horseshoe shape. Foam cushioning surrounds the tubular member to provide a degree of support and comfort for the wear prior to inflation of the tubular member. The tubular member is inflated through a transfer line or tubing from a small canister of compressed gas which may be attached at a convenient point on the collar or worn by the user elsewhere such as on a belt around the waist. A gas release trigger mechanism on the compressed gas container may be attached by cable, tether cord or other means to the vehicle for automatic inflation of the collar in a crash or collision. The collar may be provided with an outer covering of stretch fabric to limit expansion of the tubular member upon inflation and to provide a pleasing and decorative appearance for the collar. The collar may be secured to the wearer's safety helmet through velcro strips or other means attaching the fabric cover of the collar to fabric flaps extending from the helmet.

Inflatable garments are known in the prior art as exemplified by U.S. Pat. No. 3,321,785 to J. P. Soubiran, U.S. Pat. No. 3,441,963 to A. J. Steinhal, U.S. Pat. No. 3,633,230 to P. F. Horton, U.S. Pat. No. 4,887,987 to C. Kato and U.S. Pat. No. 4,925,419 to L. Susanna. The inventions of the foregoing patents, however, are directed to flotation devices to buoy persons in the water and do not provide the protection and support required for vehicle crash injury prevention or reduction.

Inflatable garments for crash injury protection are shown in U.S. Pat. Nos. 3,930,667 to A. J. Osuchowski and U.S. Pat. No. 4,825,469 to D. Kincheloe. The garments of these patents are full body suits that among other things are much more troublesome to put on and take off than the collar of the present invention.

It is an object then of the present invention to provide an automatically inflatable collar to be worn by users of open vehicles as added protection from whiplash and other neck injuries resulting from crash or collision.

It is a further object of the present invention to provide a fully portable and easily stored injury protection device for use in conjunction with safety helmets.

It is an even further object of the present invention to provide an inflatable collar neck injury protector providing the user neck support to prevent or lessen fatigue of neck and shoulder muscles when worn in the uninflated condition.

BRIEF DESCRIPTION OF THE DRAWINGS

The above and other objects and advantages of the present invention will become apparent from the following detailed description when read with reference to the accompanying drawings wherein.

DETAILED DESCRIPTION OF A PREFERRED EMBODIMENT

Figure 1:
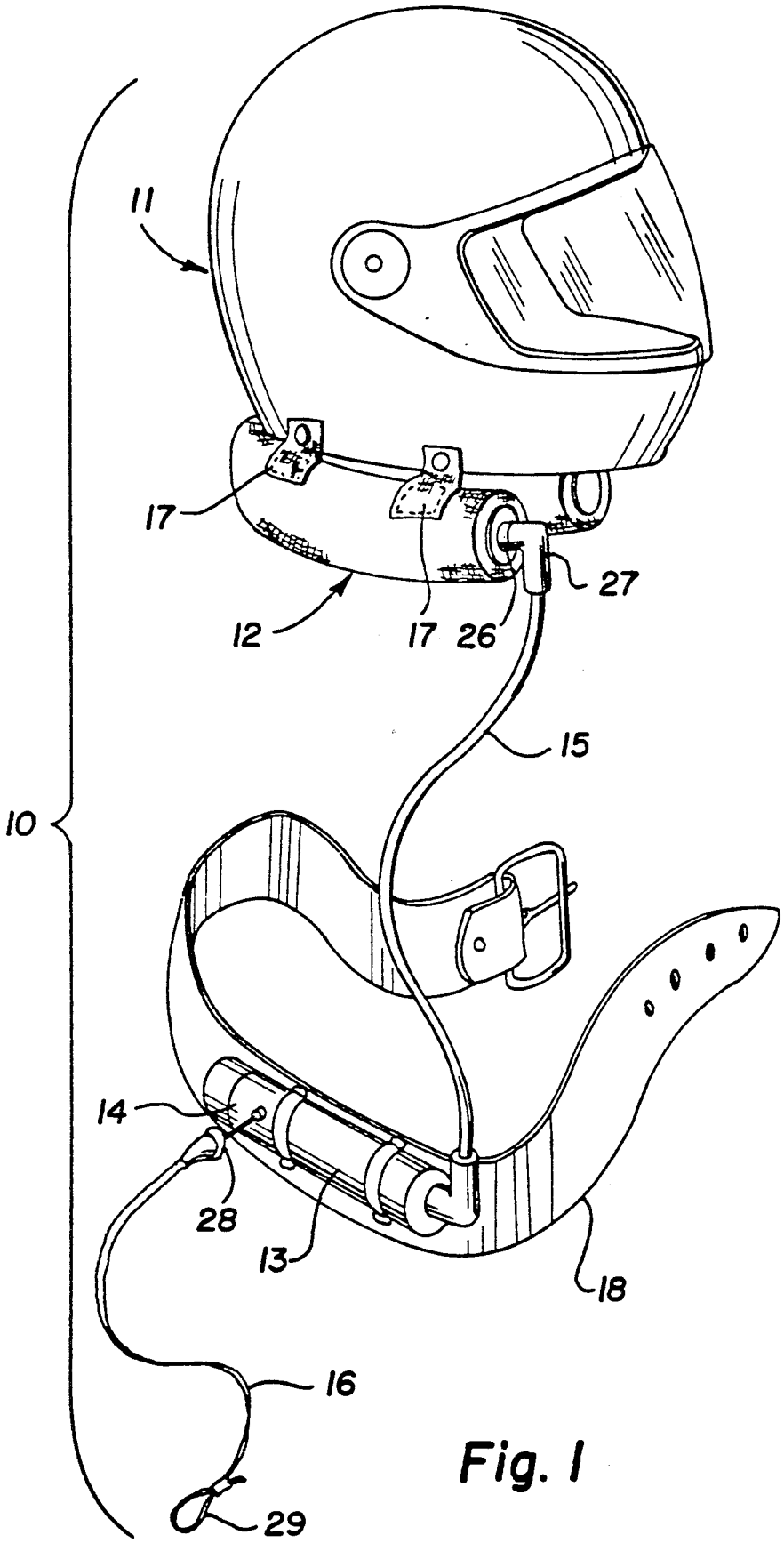
FIG. 1 is a perspective side view of the inflatable safety collar device of the present invention.

Turning now to FIG. 1 there is shown a perspective view of the inflatable collar safety device 10 of the present invention affixed to a safety helmet 11 of the type with which the safety device 10 will ordinarily be used.

The safety device 10 comprises an inflatable collar element 12, a compressed gas container 13, a gas release trigger device 14, a gas transfer pressure line 15, and a trigger actuator device 16 which may be in the form of a tether cord or cable.

The collar 12 may be attached to the user's safety helmet by means of a flap or flaps 17 depending from the helmet at appropriate points around its lower periphery. The collar may be releasably attached to the flaps 17 on each side of the helmet through well known hook and eye materials often sold under the trademark "VELCRO".

The compressed gas container 13 and trigger device 14 may be releasably attached by similar hook and eye materials to a belt 18 to be worn by the collar user. Of course, attachment of the gas container and trigger device may be by more permanent means such as by buckled or riveted straps.

Figure 2:
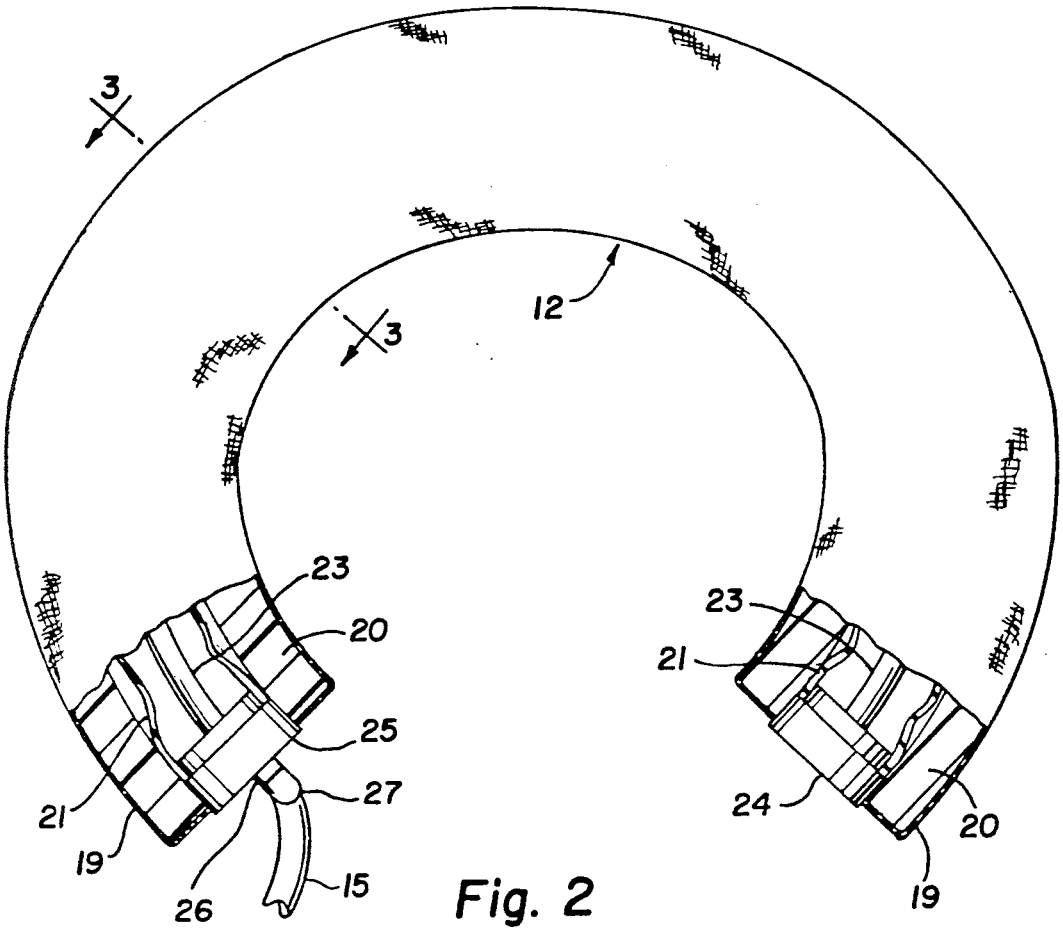
FIG. 2 is top cut-away view of the collar element of the device of the present invention.
Figure 3:
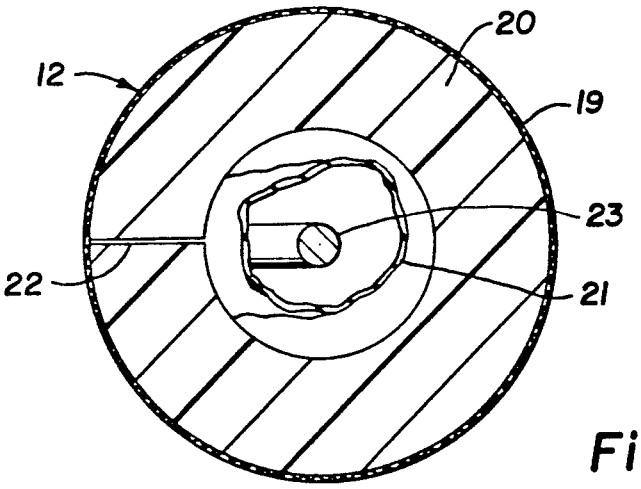
FIG. 3 is a cross-sectional view of the collar element of the present invention taken along lines 3—3 of FIG. 2.

The preferred construction of the collar element 12 is illustrated in FIGS. 2 and 3 which are top cut-away and cross-sectional views, respectively of the collar showing the various components.

As may be seen, the collar element 12 has the external shape or appearance of a partial doughnut with a generally C-shaped arcuate toroidal configuration. The external covering 19 for the collar is a strong stretchable fabric material such as certain types of nylon or such as the material sold under the trademark "SPANDEX". Within the covering 19 is a foamed cushion member 20 of arcuate shape having a generally circular or oval cross-section. Cushion member 20 is hollow through its length to accommodate an inflatable tube member 21 and is split preferably from its inner surface to its outer surface along its innermost periphery as shown at 22 to allow grater expansion of the tube member 21 upon inflation than would otherwise be accommodated.

Inflatable tube member 21 may be of a material such as rubber of the type used in making bicycle tire inner tubes or of other suitable elastomeric material.

Within tube 21 is a resilient rod 23 of arcuate shape that acts as a control ring. Rod 23 may be of plastic or metallic material. The control ring rod 23 may be attached at its ends to seal caps 24 and 25. Seal caps 24 and 25 each form a gas impervious seal with the tube member 21 at the ends of that tube. End cap 25 is provided with a gas inlet nipple 26 to which is attached the outlet end 27 of gas transfer pressure line 15. Seal caps 24 and 25 also may be of either plastic or metallic materials.

All materials of the inflatable collar safety device of the present invention are readily commercially available and are not particularly critical to the operation of the device so long as they are selected to have appropriate strength and flexibility for their intended purpose.

As can be seen the safety device of the present invention can be easily and quickly donned by the user. When worn with or without a safety helmet the collar element 12 is fitted around the neck of the wearer preferably with the opening of its "C" shape at the front. When in its deflated condition, the foamed cushion material 20 of the collar element provides firm, but sufficiently soft cushion support for the wearer's neck to be comfortable while lessening muscle tension and fatigue. The resilient control ring rod 23 allows the ends of the collar to be pulled apart by a sufficient amount to allow the collar to be slipped around the user's neck. When the ends of the collar are released the control ring fits the collar closely but comfortably around the user's neck to provide the cushioning support.

The compressed gas container 13 and trigger mechanism 14 can be attached to the collar wearer in any convenient way and place. However, it has been found quite convenient to attach the container and trigger to a belt 18 that may be quickly and easily buckled securedly around the user's waist and just as quickly and conveniently unbuckled for removal.

The tether cord actuator device 16 is attached at one end to the actuator pin 28 of the gas transfer trigger device and has provision at its other end such as loop 29 or a suitable snap fastener device for releasable attachment to the vehicle ridden by the user of the safety device.

The gas release trigger device 14 may be of the well known spring loaded type in which a sharp tug on or removal of pin 28 allows the spring to force a puncture pin and the compressed cylinder together to rupture a part of the cylinder and release the compressed gas. Of course, other suitable types of gas release mechanisms may be used. It is preferable to adjust the gas release mechanism so that the force required to actuate the trigger is more than would ordinarily be applied as the result of the wearer forgetting to detach the tether cord from the vehicle before walking away wearing the safety device.

As is apparent when the safety device of the present invention is properly worn by the rider of an open vehicle with the tether cord properly attached to the vehicle forceful removal of the rider from his proper position in or on the vehicle produces a sharp pull on the tether cord 16 sufficient to actuate the gas release trigger device producing automatically immediate inflation of the tube member 21 of the collar element 12. The inflation of tube member 21 expands the foamed cushion member 20 surrounding the tube by an amount restricted and controlled by the external covering 19 to provide much firmer neck support and thus an enhanced degree of injury protection to the user.

It is to be noted that the degree of support and cushioning offered by the collar element 12 in its uninflated condition is dependent upon the compressive strength of the material of the foamed cushion member 20 and to what extent, if any, it is compressed to fit within the external covering material 19. The support and cushioning offered by the collar element 12 in its inflated condition is dependent not only upon the compressibility factor of the cushioning material 20 and the elasticity factor of the covering 19 but also on the elasticity of the tube member 21 as well as the pressure and volume of gas released from the cylinder of container 13 upon inflation.

Thus, the support and protection factor of the collar can be determined in both its deflated and its inflated state each to a large degree independently of each other.

As a matter of convenience, the attachment fitting at the outlet end 27 of pressure line 15 may be of a quick connect-disconnect type as is well known for use on compressed air lines. With such a fitting the collar element 12 may be easily deflated when so desired. Such an attachment fitting also makes the compressed gas container 13 readily available to extinguish small fires provided, of course, that it is of the kind of gas suitable for that purpose such as $CO_2$.

Thus, there has been disclosed an inflatable collar safety device offering the wearer enhanced protection against neck injury should he be thrown from or off of an open vehicle as a result of a collision or crash. Although the safety device has been shown and described in its presently preferred embodiment many changes and modifications still within the spirit of the invention will occur to others familiar with this art. This invention, therefore, is to be limited only as set forth in the following claims:

What is claimed is:

1. A safety collar device having an inflatable collar member of a generally "C" shaped toroidal arc contour adapted to be worn about the human neck comprising:

a generally "C" shaped control ring rod member of a resilient material;

an inflatable tubular member having stretchable gas impervious walls surrounding said rod member over substantially the entire length of said rod member;

a first sealing cap closing one end of said tubular member with a gas impervious seal;

a second sealing cap having a gas inlet nipple closing the other end of said tubular member with a gas impervious seal to said tubular member;

a generally "C" shaped cushion member of resilient foamed material having toroidal arc contour and being hollow through its length and surrounding substantially the entire length of said tubular member, said cushion member being split from its inner surface to its outer surface along the innermost periphery thereof; and an external covering of stretchable fabric material surrounding said cushion member.

2. The safety collar device of claim 1 wherein said rod member is of plastic material.

3. The safety collar device of claim 1 wherein said rod member is of metallic material.

4. The safety collar device of claim 1 wherein the walls of said inflatable member are of an elastomeric material.

5. The safety collar device of claim 1 wherein the walls of said inflatable member are of rubber.

6. The safety collar device of claim 2 wherein the walls of said inflatable material are of an elastomeric material.

7. The safety collar device of claim 3 wherein the walls of said inflatable member are of rubber.

8. The safety collar device of claim 1 further comprising: a compressed gas container, a gas release trigger device, a gas transfer pressure line connected to deliver gas released from said container through said gas inlet nipple to said inflatable tubular member; and an extended trigger device operating member attachable to said vehicle.

9. The safety collar device of claim 2 further comprising: a compressed gas container, a gas release trigger device, a gas transfer pressure line connected to deliver gas released from said container through said gas inlet nipple to said inflatable tubular member; and an extended trigger device operating member attachable to said vehicle.

10. The safety collar device of claim 6 further comprising; a compressed gas container, a gas release trigger device, a gas transfer pressure line connected to deliver gas released from said container through said gas inlet nipple to said inflatable tubular member; and an extended trigger device operating member attachable to said vehicle.

11. The safety collar device of claim 8 wherein said operating member is a tether cord.

12. A safety collar device having an inflatable collar member of a generally "C" shaped toroidal arc contour adapted to be worn about the human neck comprising:

a generally "C" shaped control ring rod member of resilient metallic material;

an inflatable tubular member having stretchable rubber gas impervious walls surrounding said rod member over substantially its entire length;

a first sealing cap closing one end of said tubular member with a gas impervious seal;

a second sealing cap having a gas inlet nipple closing the other end of said tubular member with a gas impervious seal to said tubular member;

a generally "C" shaped cushion member of resilient foamed rubber material having a toroidal arc contour and being hollow through its length and surrounding substantially the entire length of said tubular member, said cushion member being split from its inner surface to its outer surface along the innermost periphery thereof; and an external covering of stretchable fabric material surrounding said cushion member.

13. The safety collar device of claim 12 further comprising: a compressed $CO_2$ gas container, a gas release trigger device, a gas transfer pressure line connected to deliver gas released from said $CO_2$ gas container through said gas inlet nipple to said inflatable tubular member; and a tether line trigger device operating member releasably attachable to a vehicle.

14. The safety collar device of claim 8 wherein said gas transfer pressure line is connected to said gas inlet nipple through a quick disconnect fitting.

15. The safety collar device of claim 13 wherein said gas transfer pressure line is connected to said gas inlet nipple through a quick disconnect fitting.

16. The safety collar device of claim 13 wherein said stretchable fabric material comprises nylon.

17. The safety collar device of claim 16 wherein said gas transfer pressure line is connected to said gas inlet nipple through a quick disconnect fitting.

18. A safety collar device having an inflatable collar member of a generally "C" shaped toroidal arc contour adapted to be worn about the human neck comprising: a generally "C" shaped control ring rod member of resilient plastic spring-like material;

an inflatable tubular member having stretchable rubber gas impervious walls surrounding said rod member over substantially its entire length;

a first plastic seal ring cap affixed to one end of said rod member and closing one end of said tubular member with a gas impervious seal;

a second plastic sealing cap affixed to the other end of said rod member and having a gas inlet nipple closing the other end of said tubular member with a gas impervious seal to said tubular member;

a generally "C" shaped cushion member of resilient foamed rubber material having a toroidal arc contour and being hollow through its length and surrounding substantially the entire length of said tubular member, said cushion member being split from its inner surface to its outer surface along its innermost periphery; and an external covering of stretchable fabric nylon material surrounding said cushion member.

19. The safety collar device of claim 18 further comprising: a compressed $CO_2$ gas container, a gas release trigger device, a gas transfer pressure line connected to deliver gas released from said container through a quick disconnect fixture to said gas inlet nipple to said inflatable tubular member; and a trigger device operating tether line member releasably attachable to a vehicle.

* * * * *